US005190010A

United States Patent [19]

Klügl et al.

[11] Patent Number: 5,190,010

[45] Date of Patent: Mar. 2, 1993

[54] ARRANGEMENT FOR REGENERATING A SOOT BURN-OFF FILTER IN THE EXHAUST DUCT OF AN AIR-COMPRESSING FUEL-INJECTED INTERNAL-COMBUSTION ENGINE

[75] Inventors: Wendelin Klügl, Kernen; Walter Pütz, Burgstetten, both of Fed. Rep. of Germany

[73] Assignee: Mercedes-Benz AG, Fed. Rep. of Germany

[21] Appl. No.: 801,467

[22] Filed: Dec. 2, 1991

[30] Foreign Application Priority Data

Dec. 22, 1990 [DE] Fed. Rep. of Germany ..... 4041627

[51] Int. Cl.[5] ..... F02D 7/00; F02D 31/00

[52] U.S. Cl. ..... 123/380; 123/393; 123/373

[58] Field of Search ..... 123/373, 380, 382, 383, 123/365, 393

[56] References Cited

U.S. PATENT DOCUMENTS

| | | | |
|---|---|---|---|
| 2,031,527 | 2/1936 | Dodson | 123/383 |
| 2,245,562 | 6/1941 | Becker | 123/380 |
| 2,305,070 | 12/1942 | Butler | 123/380 |
| 2,374,411 | 4/1945 | Camner | 123/382 |
| 2,808,819 | 10/1957 | Hagele | 123/380 |
| 2,988,872 | 6/1961 | Reggio | 123/393 |
| 3,128,751 | 4/1964 | Dahl | 123/382 |
| 4,098,368 | 7/1978 | Riddel | 123/393 |
| 4,192,272 | 3/1980 | Lang | 123/380 |
| 4,213,435 | 7/1980 | Simko | 123/382 |
| 4,664,081 | 5/1987 | Eheim | 123/380 |

FOREIGN PATENT DOCUMENTS

| | | | |
|---|---|---|---|
| 0023199 | 1/1981 | European Pat. Off. . | |
| 3602038 | 1/1987 | Fed. Rep. of Germany . | |
| 0167831 | 10/1983 | Japan | 123/380 |
| 1575392 | 9/1980 | United Kingdom . | |

*Primary Examiner*—Carl S. Miller

*Attorney, Agent, or Firm*—Evenson, Wands, Edwards, Lenahan & McKeown

[57] ABSTRACT

An arrangement for regenerating a soot burn-off filter in the exhaust duct of an air-compressing fuel injected internal combustion engine having a mechanical speed governor and an altitude matching device dependent on the atmospheric pressure into which the regenerating arrangement is integrated in such a way that, as the exhaust-gas backpressure increases, the speed governor is acted upon via the altitude matching device to reduce the injection quantity to be metered to the internal combustion engine.

3 Claims, 1 Drawing Sheet

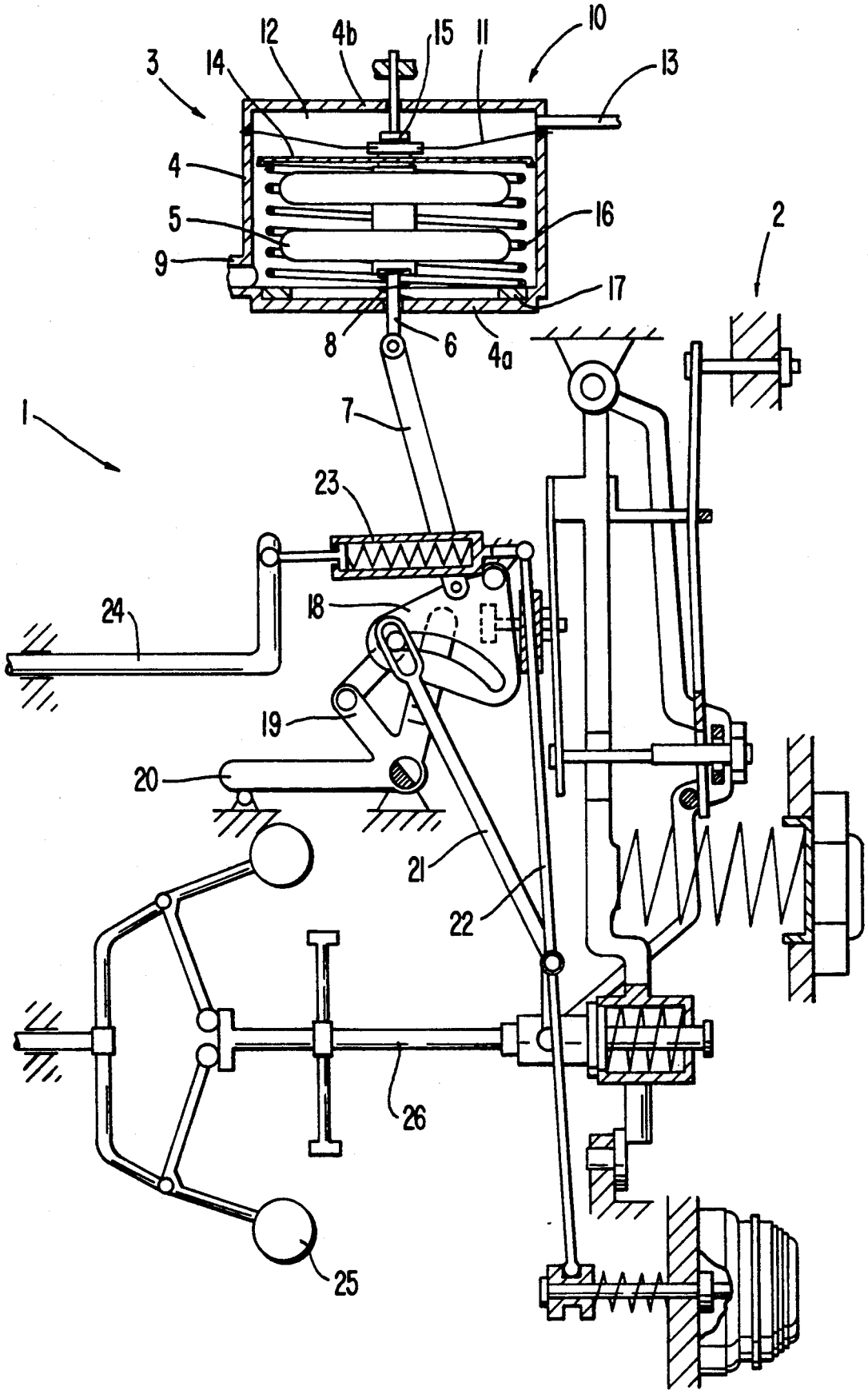
10
12
4b
15
11
3
14
13
4
5
16
2
9
17
8
6
4a
1
7
23
24
18
19
20
21
22
26
25

ARRANGEMENT FOR REGENERATING A SOOT BURN-OFF FILTER IN THE EXHAUST DUCT OF AN AIR-COMPRESSING FUEL-INJECTED INTERNAL-COMBUSTION ENGINE

BACKGROUND AND SUMMARY OF THE INVENTION

The present invention relates to an arrangement for regenerating a soot burn-off filter in the exhaust duct of an air-compressing fuel-injected internal combustion engine.

As is known, soot burn-off filters have only a limited regenerative capacity and, particularly when an internal combustion engine is operated at low load and speed, accumulate soot particles which burn off only at higher temperatures as a result of higher loads and speeds. However, a minimum oxygen content in the exhaust gas is also required for regeneration; and increasing exhaust-gas backpressure impairs the gas exchange of the internal combustion engine so that the oxygen content in the exhaust gas is decreased in the case of full-load operation at a constant injection quantity. The result is an undesireably low regeneration of the soot burn-off filter.

This disadvantage has been remedied by an arrangement disclosed in German Patent Document DE 36 02 038 C1, in which a servomechanism reduces the injection quantity metered to the internal combustion engine as a function of increasing exhaust-gas backpressure in the exhaust duct. The servomechanism is provided with a spring-loaded diaphragm which can be subjected to the exhaust-gas backpressure and, and which has a diaphragm rod operatively connected to the governor linkage of a speed governor.

It is an object of the present invention, in an internal combustion engine already having an adjustment device which influences the injection quantity, to provide apparatus which requires little construction expenditure, which avoids impairment of the functioning of the arrangement that can be subjected to the exhaust-gas backpressure, and which effects the regeneration of the soot burn-off filter.

This and other objects and advantages are achieved by the regeneration arrangement according to the invention, in which due to a special structurally unitary combination of the regenerating arrangement with the altitude-matching device, only a low expenditure on construction is required. The exhaust-gas backpressure acting on the diaphragm thus acts via the altitude-matching device on the governor linkage of the speed governor and correspondingly compensates the injection quantity to be metered to the internal combustion engine.

Other objects, advantages and novel features of the present invention will become apparent from the following detailed description of the invention when considered in conjunction with the accompanying drawings.

BRIEF DESCRIPTION OF THE DRAWINGS

The single figure is a partially sectional depiction of a filter regeneration arrangement according to the invention.

DETAILED DESCRIPTION OF THE DRAWINGS

Referring to the Figure, a mechanical speed governor 2, coupled to a fuel injection pump 1, is operatively connected to an altitude-matching device 3 which responds to changes in the atmospheric pressure. In the housing 4 of the altitude matching device 3 a barometer capsule 5 having a rod-shaped adjusting part 6 is guided. The adjusting part 6 protrudes from the housing 4 and is articulated on a transmission rod 7, which is part of the governor linkage in the speed governor 2. In the event of changes in length of the adjusting part 6 protruding from the housing 4 due to decreasing ambient air pressure, the barometer capsule 5 acts against a spring 8 which surround the adjusting part 6 between the barometer capsule and the bottom 4*a* of the housing 4. Reference numeral 9 denotes the vent tube opening into the housing 4.

Integrated into the housing 4 of the altitude-matching device 3 is an arrangement which depends on the exhaust-gas backpressure. A servomechanism 10 which has a diaphragm 11 delimits a diaphragm chamber 12 which is connected via an exhaust-gas backpressure line 13 to an exhaust duct (not shown) of an air-compressing fuel-injected internal combustion engine, the said exhaust duct having a soot burn-off filter.

Due to the force of spring 8, the barometer capsule 5 rests via a supporting disc 14 against the diaphragm 11, which, for its part, rests against an adjustable stop 15 in the lid 4*b* of the housing 4.

Exhaust-gas backpressure input via the diaphragm 11 acts not only against the spring 8 but also against a diaphragm spring 16 which surrounds the barometer capsule 5 and is arranged between supporting disc 14 and a shim 17 resting on the bottom 4*a* of the housing. As described below, the diaphragm 11 and, in particular, the diaphragm spring 16, are designed so that, as the exhaust-gas backpressure rises, the oxygen content during full-load operation of the internal combustion engine does not decrease in the exhaust duct, and in fact may increase. The prestressing force of the diaphragm spring 16 can be set precisely, mainly using one or more shims 17.

As the exhaust-gas backpressure increases, the diaphragm 11 and the barometer capsule 5 are deflected—without a change in the length of this capsule. In response to the downward movement of the diaphragm 11, the adjusting part 6 and the transmission rod 7 are also moved downward and adjust a slotted link 18 in the speed governor, which is of conventional design. Guided in sloted link 18 are a guide lever 19 of a load-dependent adjusting lever 20 and a reversing lever 21. Reversing lever 21 actuates the governor lever 22, which, via a yielding link 23, actuates the control rod 24 of the fuel injection pump in the direction of a small quantity. At its end facing away from the slotted link 18, the reversing lever 21 is pivotably connected to a socket rod 26 interacting with the flyweight arrangement 25.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Arrangement for regenerating a soot burn-off filter in the exhaust duct of an air-compressing fuel-injected internal combustion engine, comprising:

a servomechanism which acts on a mechanical speed governor of a fuel injection pump of said engine to reduce a quantity of fuel injected to said engine as exhaust-gas backpressure increases, wherein the servomechanism is integrated into an altitude-matching device of said speed governor, the altitude matching device being adapted to adjust the quantity of fuel injected to said engine in response to changes in atmospheric pressure;

said servomechanism comprising a diaphragm chamber connected via an exhaust-gas backpressure line to the exhaust duct, and a spring-loaded diaphragm which can be subjected t the exhaust-gas backpressure; and said altitude-matching device comprising a barometer capsule guided in a housing, acting against a spring and having an adjusting part articulated on a transmission rod as part of the governor linkage in the speed governor, said barometer capsule being surrounded by the diaphragm spring, which is supported, on the one hand, against the bottom of the housing and, on the other hand, via the diaphragm, against an adjustable stop.

2. Fuel-injected internal combustion engine according to claim 1 wherein a supporting plate for the diaphragm spring is mounted between the diaphragm and the barometer capsule.

3. Fuel-injected internal combustion engine according to claim 1, wherein at least one shim is provided between the diaphragm spring and the bottom of the housing.

* * * * *